US005205002A

United States Patent [19]

Sage-Passant

[11] Patent Number: 5,205,002

[45] Date of Patent: Apr. 27, 1993

[54] COUPLING APPARATUS

[76] Inventor: Peter Sage-Passant, Mechline Limited Taylor Street, Luton, Bedfordshire LU2 0EY, England

[21] Appl. No.: 717,408

[22] Filed: Jun. 18, 1991

[30] Foreign Application Priority Data

Feb. 5, 1991 [GB] United Kingdom ..... 9102466

[51] Int. Cl.[5] ..... E03C 1/322; E03C 1/02; E03C 1/182

[52] U.S. Cl. ..... 4/643; 4/653; 285/33

[58] Field of Search ..... 4/191, 192, 538, 546, 4/619, 638, 643, 653; 285/33, 137.1, 921; 137/360, 361, 899; 134/115 R

[56] References Cited

U.S. PATENT DOCUMENTS

| | | | |
|---|---|---|---|
| 1,825,033 | 9/1931 | Walker | 4/638 X |
| 2,287,657 | 6/1942 | Wisckol | 4/653 X |
| 3,170,667 | 2/1965 | Szohatzky | 137/360 X |
| 3,623,166 | 11/1971 | Wilkinson | 4/191 |
| 4,371,995 | 2/1983 | Donhauser | 4/546 X |
| 4,420,006 | 12/1983 | Moore et al. | 134/115 R X |
| 4,716,925 | 1/1988 | Prather | 137/360 |
| 4,935,971 | 6/1990 | Dunn et al. | 4/546 X |
| 5,029,606 | 7/1991 | Kuhlthau, Jr. | 137/360 |

FOREIGN PATENT DOCUMENTS

| | | | |
|---|---|---|---|
| 1459600 | 8/1969 | Fed. Rep. of Germany | 4/643 |
| 2063622 | 7/1971 | Fed. Rep. of Germany | 4/191 |
| 0226941 | 9/1989 | Japan | 4/191 |

*Primary Examiner*—Henry J. Recla
*Assistant Examiner*—Robert M. Fetsuga
*Attorney, Agent, or Firm*—Dilworth & Barrese

[57] ABSTRACT

Apparatus for coupling to a free-standing washing unit feed lines for hot and cold water and a waste line for waste water includes a wall mountable connection unit supporting first and second service line base connector elements extending away from the wall, each for connection to a different hot and cold water service line at the wall, and a waste line base connector element for connection to a waste line at the wall. First and second satellite connector elements are provided, each being engageable in fluid-tight manner to a different one of the service line base connector elements. A satellite waste line connector engageable in fluid-tight manner to the waste line base connector element. The satellite connector elements and waste line elements are arranged to be mounted, in use, to the washing unit whereby the washing unit may be freely moved between an operational disposition adjacent the wall with the respective base and satellite connectors mutually engaged and a de-coupled disposition away from the wall, with all the respective connectors disengaged. Latching mechanism is also provided for maintaining the washer unit in the operational disposition until release thereof allows transition to the de-coupled disposition.

8 Claims, 3 Drawing Sheets

COUPLING APPARATUS

BACKGROUND OF THE INVENTION

1. Field of the Invention

This invention relates to apparatus for coupling fluid flow lines and a unit of catering equipment. More particularly, but not exclusively, the invention concerns apparatus for coupling together fluid flow lines and a sink unit.

2. Prior Art

Commercial catering establishments are subject to stringent health and hygiene requirements. Ease of access for cleaning purposes is a major consideration in the design of kitchens and catering equipment. It is increasingly common for units to be mobile, thereby allowing staff full access to clean both the equipment itself and the underlying floor area. However, not all catering equipment is readily made mobile. Sink units and ovens or hobs, for example, necessarily require connection to feed services, and it is these connections which have hitherto limited such units to static fixtures. Unfortunately, it is around these very fixtures that a large proportion of food handling is done, and thus it is essential that they, and the area around them, can be adequately cleaned. Flexible links between the service supply ports and the unit have been suggested, but these are cumbersome to accommodate when the unit is in place, prone to leakage and themselves pose not inconsiderable cleaning difficulties. It is a combination of these problems that makes the use of flexible links at least unattractive, and often unacceptable.

SUMMARY OF THE INVENTION

It is an object of the present invention to overcome, or at least reduce, the problems of cleaning catering equipment requiring service connections.

According to the present invention there is provided apparatus for coupling to a free-standing washing unit feed lines for hot and cold water and a waste line for waste water, the apparatus being characterized by:

(i) a wall-mountable connection unit supporting first and second service line base connector elements extending away from the wall and each for connection to a different hot and cold water service line at the wall and a waste line base connector element for connection to a waste line at the wall;

(ii) first and second satellite connector elements, each engageable in fluid-tight manner to a different one of the service line base connector elements, and a satellite waste line connector engageable in fluid-tight manner to the waste line base connector element, and each to be mounted, in use, to the washing unit, whereby the washing unit may be freely moved between an operational disposition adjacent the wall with the respective base and satellite connectors mutually engaged, and a de-coupled disposition away from the wall, with all the respective connectors disengaged; and (iii) latching means for maintaining the washing unit in the operational disposition until release of the latching means allows transition to the de-coupled disposition.

Preferably the connection unit takes the form of a connection box.

Preferably, all the supply lines have double shut-off base and satellite connector assemblies.

Preferably the first and second base connectors are in spaced apart horizontal alignment and the waste connector is arranged in an offset position between them. Preferably the waste connector is offset above the first and second base connectors to form the vertices of an acute angled triangle.

Preferably the washing unit has a single operating lever to operate the latching means. For example, the single lever may be connected to sleeves on the satellite connectors of the hot and cold water supply lines. The single lever may be actuated by a pedal mechanism mounted on an underframe.

Preferably the latching means is arranged within the triangular area defined by the three connectors.

Preferably a waste water trap is housed in the wall mountable connection unit. Preferably the connection between the washer and the connection unit includes an electrical earth connection, and preferably the washing unit is mounted on wheels, rollers or castors.

BRIEF DESCRIPTION OF THE DRAWINGS

For a better understanding of the present invention, and to show more clearly how the same may be carried into effect, reference will now be made, by way of example, to the accompanying drawings, in which.

DESCRIPTION OF THE PREFERRED EMBODIMENTS

Figure 1:
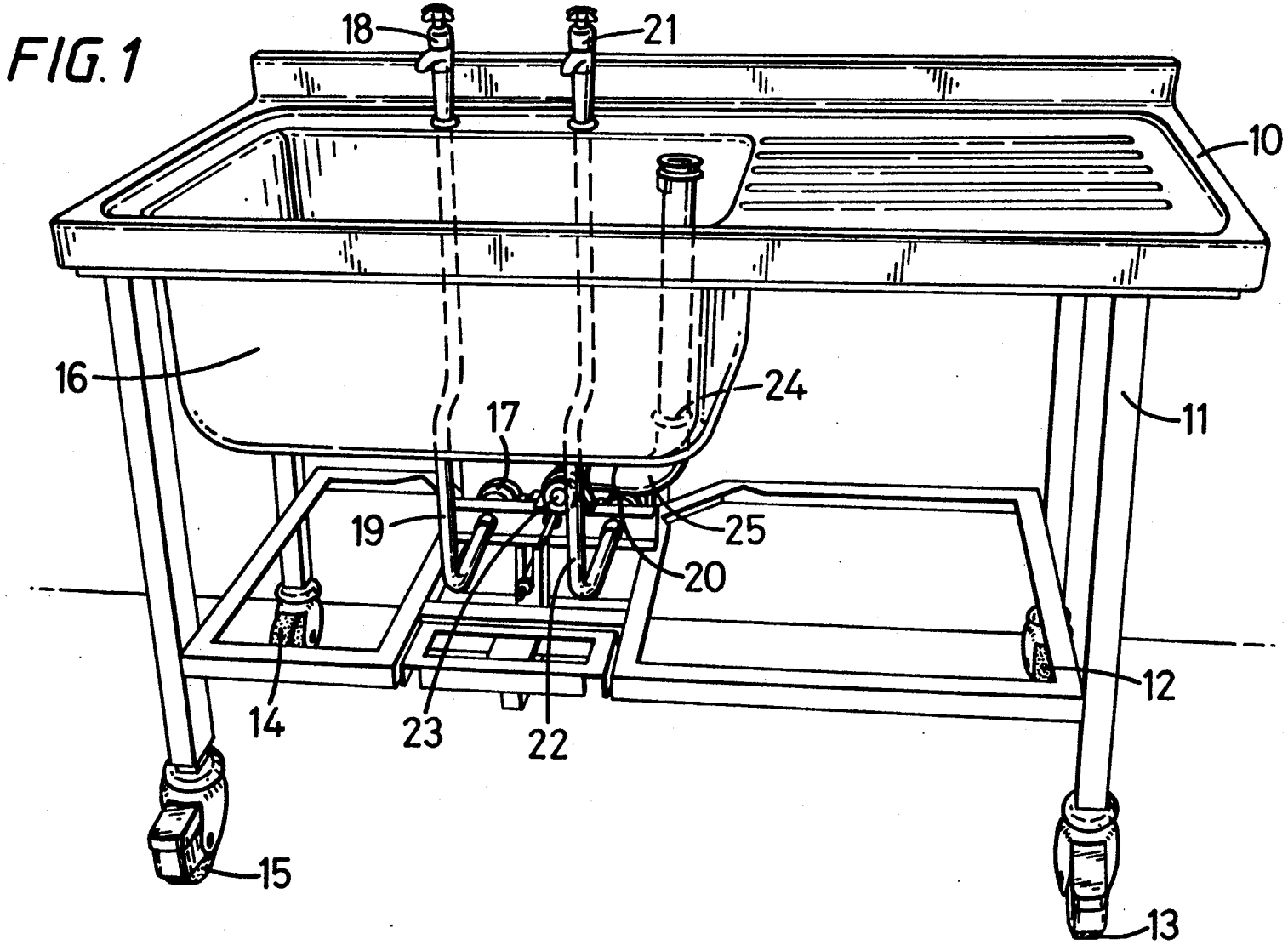
FIG. 1 is a front view of a sink unit such as may be used in the apparatus of the present invention, the unit carrying satellite connector elements of a first embodiment of the invention.

Referring to FIG. 1, a standard sink unit top 10 has an underframe 11 modified to receive castors 12, 13, 14 and 15. Carried on the underframe 11 adjacent to the underside of the sink bowl 16, are the satellite connector elements. A first satellite connector 17 communicates with a first sink tap 18 through a first water flow line 19, and likewise a second satellite connector 20 communicates with a second sink tap 21 through a second water flow line 22. A satellite waste connector 23 communicates with the drain hole 24 of the sink bowl 16, through a waste flow line 25.

Figure 2:
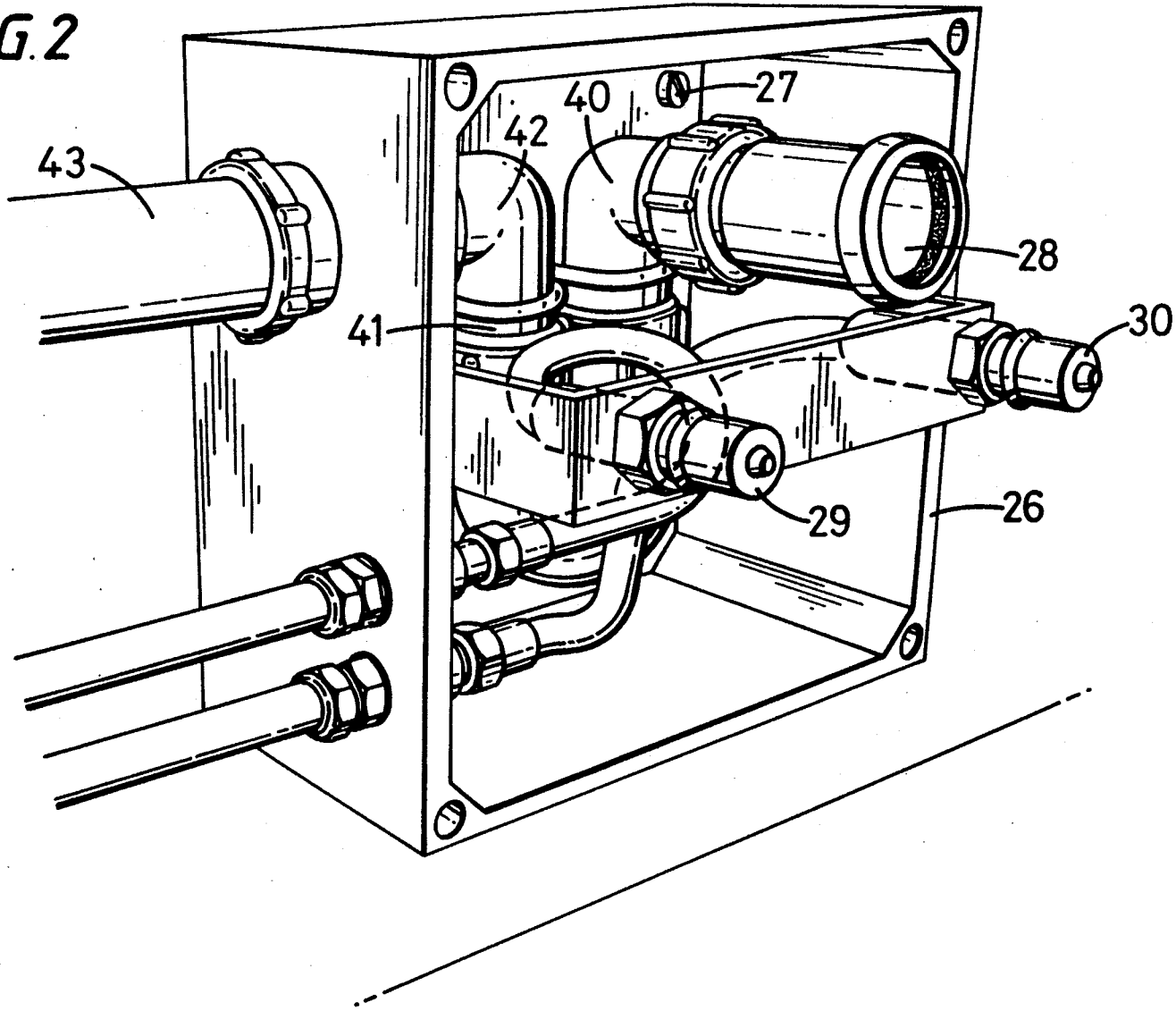
FIG. 2 is a perspective view of the wall mountable connection unit of the first embodiment of the invention.

Referring to FIG. 2 the connection unit 26 is mounted to the wall by four fixings 27. The base waste water connector 28 is disposed in a position superior to both a first base connector element 29 and a second base connector element 30 which are arranged horizontally in line. The base waste water connector 28 forms one limb of an elbow 40 which communicates with a trap 41 and a downstream elbow 42 from which connection may be made to an ongoing downstream waste pipe 43. Base connectors 29 and 30 are double shut off couplings which automatically self-seal when disengaged from the satellite connectors 17 and 20, in order to prevent escape of water from within supply lines 19 and 22 respectively.

Figure 3:
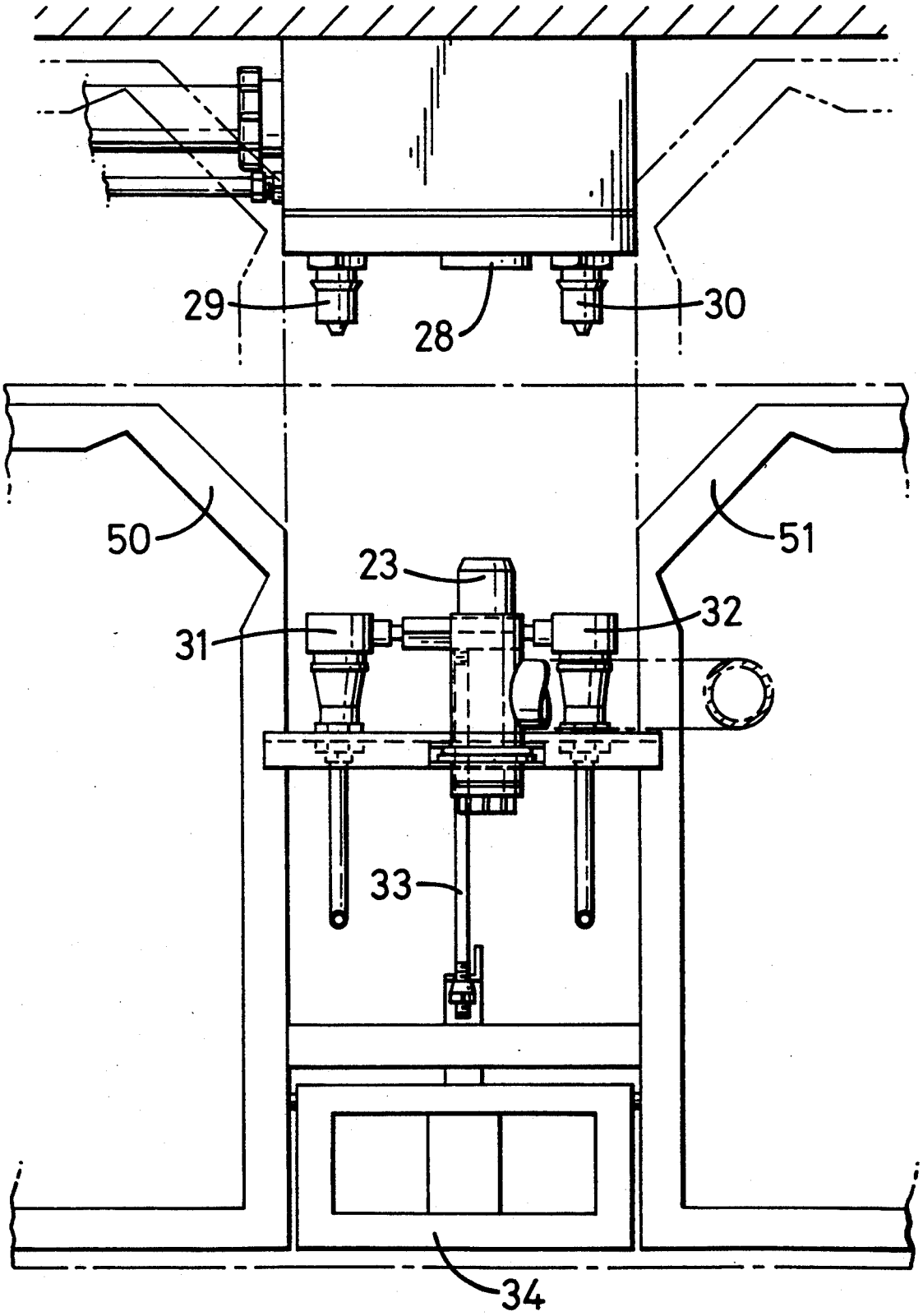
FIG. 3 is a top plan view of the wall mountable connection unit, the satellite connector elements and the pedal actuated operating lever in a de-coupled disposition. The chain-dotted lines show the unit in coupled disposition.

FIG. 3 shows how the base and satellite connectors engage when the sink unit is brought into abutment with the wall. The satellite connector 23 makes a press fit sealing engagement with its co-operating base connection 28.

Each of the satellite connectors 17 and 20 has a sleeve 31 and 32 respectively which engages over the spigot end of the corresponding base connectors 29 and 30 for latching engagement of these connectors. The double shut-off connectors are well known in themselves, and the base and satellite connector portions are self sealing until such time as they are in latched engagement.

When bringing the sink unit into abutment with the wall, the unit is guided into its appointed position by co-operation between the bevelled edges 50 and 51 on the back of the underframe 11 and the sides of the connection unit 26.

A link rod 33 actuated by a pedal 34 mounted on the underframe 11 connects via a yoke to the sleeves 31 and 32 of the satellite connector elements 17 and 20.

In use full operational coupling of the catering unit to the services at the connection box 26 is achieved simply by pressing the sink unit into its appointed place against the wall, wherein upon the three satellite connections mounted to the sink unit 10 make engagement with the corresponding three base connectors in the connection unit 26.

For cleaning around the sink unit, depression of the pedal 34 causes the link rod 33 to displace longitudinally thereby pulling the sleeves 31 and 32 axially away from the base connection spigots 29 and 30, to release both these two supply line connectors. Thus pulling the sink unit from the coupled disposition to its de-coupled disposition will not result in release of water to the floor.

To re-engage the sink unit with the connection unit 26 no manipulation of the pedal 34 is necessary. Instead simply moving the sink unit into the wall will achieve fresh latching engagement of the supply line connectors 28, 29 and 30.

In another embodiment, re-engagement of the sink unit with the connection unit 26 requires depression of the pedal 34 to displace the sleeves 31 and 32 axially to allow the connection unit to be engaged with the satellite connectors 17 and 20.

Once in position the pedal is released and the satellite connectors make latching engagement with the spigots 29 and 30. In another embodiment (not shown) no manipulation of the pedal is necessary. Instead simply moving the sink unit into the wall will achieve fresh latching engagement of the supply line connectors.

The washing unit need not be a sink. It could be, for example, a dish washer or a clothes washer.

I claim:

1. A washing unit including an apparatus for coupling to a free-standing washing unit feed liens for hot and cold water and a waste line for waste water, the apparatus comprising:

(i) a wall-mountable connection unit supporting first and second service line base connector elements extending away from the wall and each for connection to a different hot and cold water service lien at the wall, and a waste line base connector element for connection to a waste line at the wall;

(ii) first and second satellite connector elements, each engageable in fluid-tight manner to a different one of the service lien base connector elements, and a satellite waste line connector engageable in fluid-tight manner to the waste line base connector element, and each to be mounted, in use, to the washing unit whereby the washing unit may be freely moved between an operational disposition adjacent the wall with the respective base and satellite connectors mutually engaged, and a de-coupled disposition away from the wall, with all the respective connectors disengaged; and (iii) latching means for maintaining the washing unit in the operational disposition until release of the latching means allows transition to the de-coupled disposition; and (iv) the washing unit having bevel frame elements to guide the washing unit from the de-coupled disposition into the operational disposition.

2. A washing unit as claimed in claim 1 wherein the unit is wheeled.

3. A washing unit as claimed in claim 1 which is a sink unit.

4. A washing unit as claimed in claim 1 wherein the first and second connector elements are in spaced apart, horizontal alignment and the waste connector is arranged in an offset position between them so that the three connectors form the vertices of a triangle.

5. A washing unit as claimed in claim 4 wherein the latching means is arranged within the triangular area defined by the three connectors.

6. A washing unit as claimed in claim 1 wherein the connection unit includes a water waste trap connected to an outlet of the waste line base connector element.

7. A washing unit as claimed in claim 1 wherein the service lien base and satellite connectors are double shut-off connectors.

8. A washing unit as claimed in claim 1 and including an operating lever to operate the latching means to release the satellite connector elements from a latched disposition before the unit may be moved to its de-coupled disposition.

* * * * *